US010947078B2

(12) United States Patent
Morris

(10) Patent No.: US 10,947,078 B2
(45) Date of Patent: Mar. 16, 2021

(54) WINDING SYSTEM FOR ELONGATED ELEMENTS

(71) Applicant: Milliken & Company, Spartanburg, SC (US)

(72) Inventor: David Drew Morris, Newnan, GA (US)

(73) Assignee: Milliken & Company, Spartanburg, SC (US)

( * ) Notice: Subject to any disclaimer, the term of this patent is extended or adjusted under 35 U.S.C. 154(b) by 157 days.

(21) Appl. No.: 16/248,932

(22) Filed: Jan. 16, 2019

(65) Prior Publication Data

US 2019/0225455 A1 Jul. 25, 2019

Related U.S. Application Data

(60) Provisional application No. 62/621,325, filed on Jan. 24, 2018.

(51) Int. Cl.

| | |
|---|---|
| ***B65H 49/08*** | (2006.01) |
| ***B65H 54/06*** | (2006.01) |
| ***B65H 54/56*** | (2006.01) |
| ***B65H 55/04*** | (2006.01) |

(52) U.S. Cl.

CPC ..... *B65H 49/08* (2013.01); *B65H 54/06* (2013.01); *B65H 54/56* (2013.01); *B65H 55/04* (2013.01); *B65H 2701/37* (2013.01)

(58) Field of Classification Search

CPC .... B65H 2701/37; B65H 49/08; B65H 54/06; D06B 23/08

See application file for complete search history.

(56) References Cited

U.S. PATENT DOCUMENTS

| | | | | |
|---|---|---|---|---|
| 1,178,566 A * | 4/1916 | Wright | 242/128 |
| 1,333,147 A * | 3/1920 | Wright | D01H 1/305 242/128 |
| 3,243,949 A | 4/1966 | Flanigan | 57/157 |
| 3,272,455 A | 9/1966 | Sternberg et al. | 242/171 |
| 3,806,054 A * | 4/1974 | Johnson | B65B 13/18 242/128 |
| 3,955,390 A | 5/1976 | Geary | 72/64 |
| 4,508,317 A | 4/1985 | Conti | 254/134.3 FT |
| 4,580,399 A | 4/1986 | Henrich | 57/59 |
| 4,597,255 A | 7/1986 | Hunter et al. | 57/62 |

(Continued)

FOREIGN PATENT DOCUMENTS

| | | |
|---|---|---|
| DE | 849 868 | 9/1952 |
| EP | 1 422 731 | 6/2004 |

(Continued)

OTHER PUBLICATIONS

Patent Cooperation Treaty PCT International Search Report, dated Apr. 2, 2019. International Application No. PCT/US2019/013948. International Filing Date: Jan. 17, 2019.

*Primary Examiner* — Shaun R Hurley

(74) *Attorney, Agent, or Firm* — Cheryl Brickey

(57) ABSTRACT

A winding system contains a let off stand, a winding coordinator, and a wind-up stand. The left off stand contains a tape holder and a generally planar base which rotates in a first direction. The winding coordinator contains a generally planar section having an opening for an elongated element and rotates in a second direction opposite to the first direction.

8 Claims, 4 Drawing Sheets

(56) References Cited

U.S. PATENT DOCUMENTS 4,735,351 A 4/1988 Biswas ..... 225/25
RE32,996 E * 7/1989 Takahashi ..... B21C 47/16 242/420.6
4,848,694 A * 7/1989 Julian ..... B21C 47/16 242/420.6
5,046,674 A 9/1991 Kolschbach et al. ..... 242/54 R
5,123,607 A * 6/1992 Jones ..... B65H 49/34 242/420.6
5,323,982 A * 6/1994 Ligon ..... B65H 49/16 139/450
5,415,188 A 5/1995 Altshuler ..... 132/325
5,666,704 A * 9/1997 Price ..... D06B 23/08 26/51
5,803,393 A * 9/1998 Julian ..... B65H 49/28 242/420.6
5,918,353 A * 7/1999 Jacumin ..... D06B 23/08 26/71
6,726,142 B2 * 4/2004 Abba ..... B65H 49/34 242/566
6,735,933 B2 * 5/2004 Abba ..... D01H 1/003 57/2.3
D500,087 S 12/2004 Siegel ..... D19/69
7,065,948 B2 * 6/2006 Kranich ..... B65H 23/00 57/264
7,188,642 B2 3/2007 James et al. ..... 139/384 R
7,328,568 B2 * 2/2008 Rahn ..... B65H 19/18 57/31
7,690,179 B2 * 4/2010 Johnson ..... D01H 9/04 57/1 UN
7,754,971 B2 7/2010 Bedingfield et al. ..... 174/117
7,799,997 B2 9/2010 Bedingfield et al. ..... 174/93
9,303,355 B2 * 4/2016 Willson ..... F16H 3/44
9,540,749 B2 1/2017 Bedingfield
10,144,610 B2 12/2018 Himmelsbach et al.
2003/0121244 A1 * 7/2003 Abba ..... D01H 1/003 57/2.3
2003/0122028 A1 * 7/2003 Abba ..... B65H 49/34 242/566
2004/0129752 A1 * 7/2004 Kranich ..... B65H 23/00 226/10
2012/0110955 A1 5/2012 Rekieta et al. ..... 53/430
2015/0203324 A1 * 7/2015 Meachum ..... B65H 49/205 242/588.6
2016/0257523 A1 * 9/2016 Johnson ..... B65H 49/28

FOREIGN PATENT DOCUMENTS

GB 682 383 11/1952
GB 2 143 870 2/1985

* cited by examiner

WINDING SYSTEM FOR ELONGATED ELEMENTS

RELATED APPLICATIONS

This application claims priority to U.S. Provisional Patent Application 62/621,325 filed on Jan. 24, 2018 and is herein incorporated by reference in its entirety.

TECHNICAL FIELD

The present invention relates generally to winding and dispensing systems, more particularly to winding and dispensing systems that when unwound has little or essentially no twist.

BACKGROUND

There are many markets that have a need for smaller amounts of elongated elements such as pull tapes in an easy to use, transport, and dispense container. When these elongated elements are pulled from the end of a spool (or spool like configuration) from the container, the elongated element has twists which makes the use of the elements more difficult. There is a need for a winding and dispensing system that when unwound has little or essentially no twist.

BRIEF SUMMARY OF THE INVENTION

A dispenser system containing a container and a single elongated element. The container has an inner surface, an outer surface, and at least one opening, and is configured to enclose a volume. The single elongated element has two ends and is rotationally wound in a first direction into a hollow cylinder having a central axis. The hollow cylinder is a three-dimensional region bounded by inner and outer concentric cylindrical sections and two parallel annular bases perpendicular to the central axis. The hollow cylinder is located within the volume of the container and the hollow cylinder and container are configured such that the single elongated element is unwound from the hollow cylinder from one of the annular bases approximately parallel to the central axis. The single elongated element has a twist in a second direction opposite to the first direction such that when the single elongated element is unwound it has essentially no twist.

A winding system containing a let off stand, a winding coordinator, and a wind-up stand. The left off stand contains a tape holder and a generally planar base, where the tape holder is configured to hold a single elongated element and the base rotates in a first direction within the plane of the base. The winding coordinator contains a generally planar section having an opening for an elongated element and rotates in a second direction opposite to the first direction. The wind-up stand contains a spool core.

A method of winding beginning by unwinding a single elongated element from a tape holder stand, where the tape holder stand comprises a tape holder and a generally planar base. The tape holder is configured to hold elongated elements and the base rotates in a first direction within the plane of the base. The method also contains the step of passing the single elongated element through a winding coordinator containing a generally planar section having an opening which the single elongated element passes through. The generally planar section rotates in a second direction opposite to the first direction and the let off roll and the winding coordinator rotate at approximately the same frequency. The method also contains the step of circumferentially winding the single elongated element on a wind-up stand containing a spool core forming a hollow cylinder. The hollow cylinder has a central axis and is a three-dimensional region bounded by inner and outer concentric cylindrical sections and two parallel annular bases perpendicular to the central axis. The single elongated element contains a plurality of twists, approximately one twist for each full circumferential winding rotation of the single elongated element within the hollow cylinder.

BRIEF DESCRIPTION OF THE DRAWINGS

The present invention is best understood with reference to the following detailed description of embodiments of the invention when read in conjunction with the attached drawings, in which like numerals refer to like elements, and in which.

DETAILED DESCRIPTION

Figure 1A:
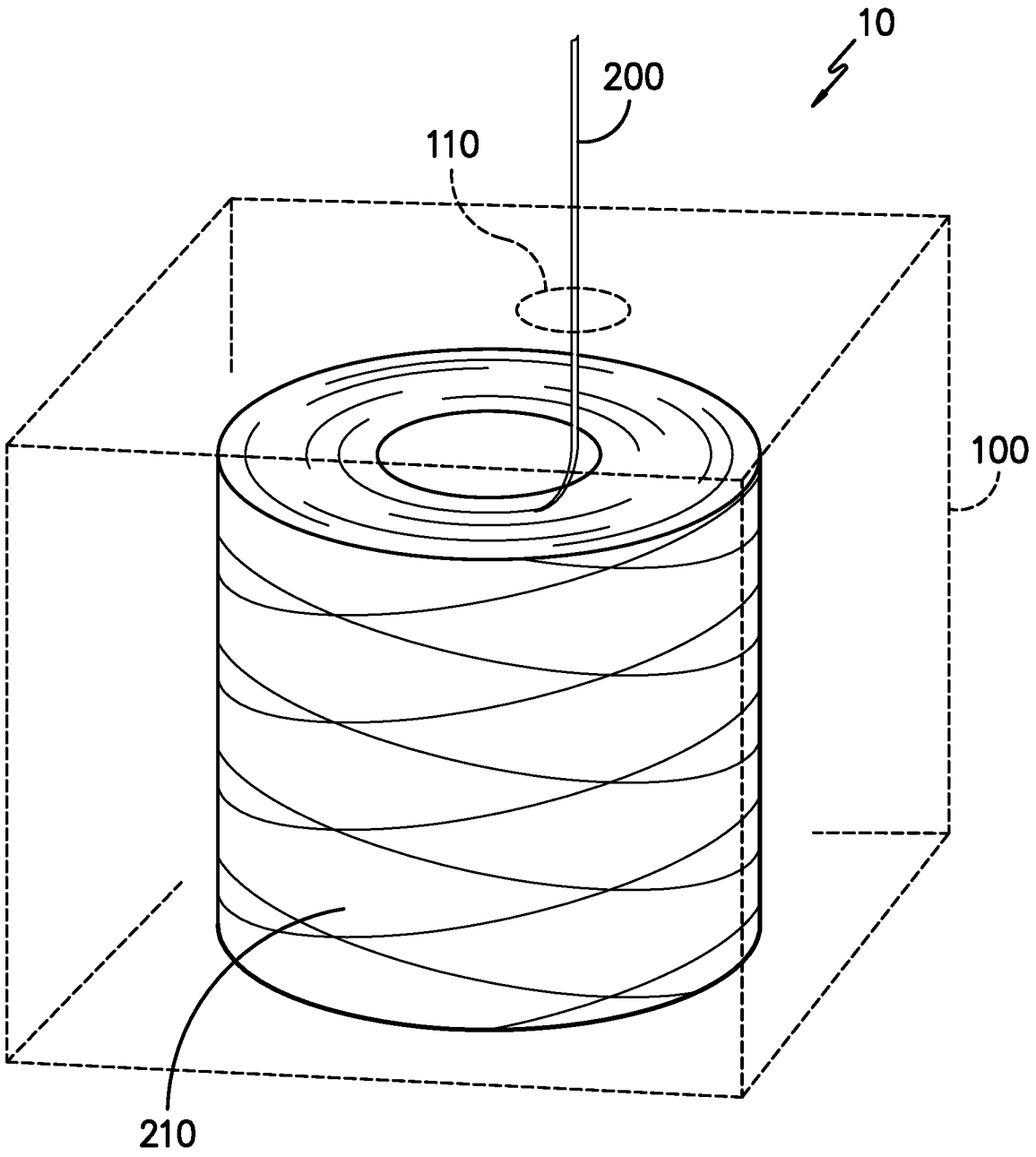
FIGS. 1A and 1B are illustrations of embodiments of the dispensing system.
Figure 1B:
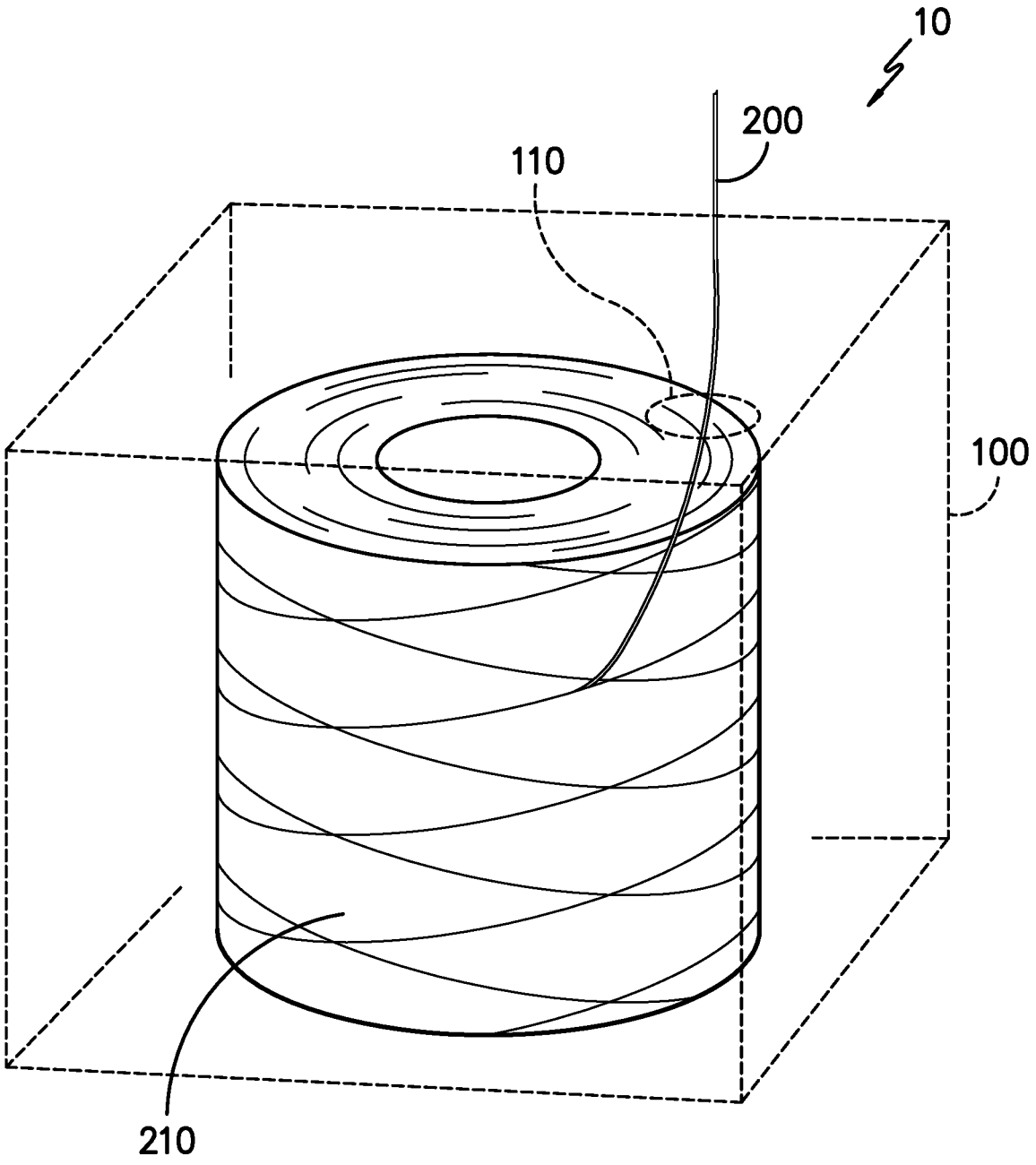

Referring now to FIGS. 1A and 1B, there are shown illustrations of two embodiments of a dispenser system 10. The dispenser system 10 contains a container 100 and a single elongated element 200. The container 100 has an inner surface, an outer surface, and at least one opening 110 and the container is configured to enclose a volume.

The container 100 may be any suitable shape and made from any suitable material. The container should be large enough to hold the entire elongated element 200 and protect the element 200 from the environment (such as rain and dirt). In one embodiment, the container may be cylindrical such as a bucket or pail or may be rectangular cuboid. The container may be any suitable material such as plastic, cardboard, metal, or a combination thereof. In addition, material may be added to the container between the element 200 and the inner surface of the container to fill any voids and keep the element 200 stable within the container.

The single elongated element 200 may be any suitable elongated element such as wires, pull tapes, pull ropes, ribbons, and cables. In a preferred embodiment, the single elongated element 200 is a tape element. Tape elements are used as pull tapes which are typically tightly woven, relatively flat strips of material used typically for pulling cables through the channels. They typically have a rectangular cross-sectional shape. In one embodiment, the pull lines are formed of tightly woven, polyester material, which exhibits a tensile strength of between about 400 pounds and about 3,000 pounds. Pull cords (or ropes) having a substantially round cross-section may be used successfully with smaller diameter cables.

Figure 2:
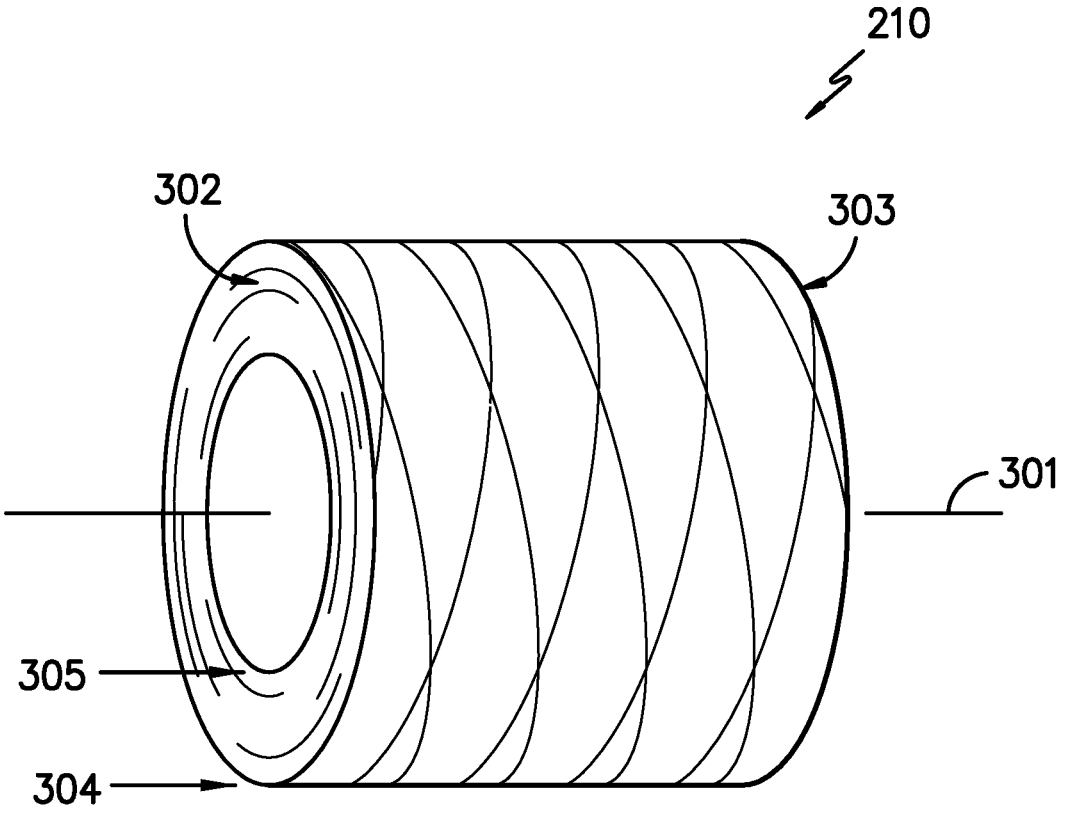
FIG. 2 is an illustration of the hollow cylinder.

The single elongated element 200 has two ends and is rotationally wound in a first direction into a hollow cylinder having a central axis. The shape that is formed by the wound elongated element 200 is a hollow cylinder 210 such as shown enlarged in FIG. 2. The hollow cylinder 210 is defined as being a three-dimensional region bounded by inner 305 and outer 304 concentric cylindrical sections and two parallel annular bases 302, 303 perpendicular to the central axis 301. The hollow cylinder 210 is located within the volume of the container 100. The hollow cylinder 210 and container 100 are preferably configured such that the single elongated element 200 is unwound from the hollow cylinder 210 from one of the annular bases 302, 303 approximately parallel to the central axis 301. In one embodiment, the single elongated element 200 is unwound from the hollow cylinder from one of the annular bases 302, 303 from the inner cylindrical section 305 meaning that the element 200 is being pulled from the inside of the cylinder 210 such as shown in FIG. 1A. In another embodiment, the single elongated element 200 is unwound from the hollow cylinder from one of the annular bases 302, 303 from the outer cylindrical section 304 meaning that the element 200 is being unwound from the outside of the cylinder 210 such as shown in FIG. 1B. Whether the element 200 is unwound from the inside or outside of the cylinder 210 depends on the container 100 configuration and the materials of the elongated element 200.

In a typical hollow cylinder 210, when the elongated element 200 is pulled from one of the annular bases, the element would have a twist in it (approximately one twist per revolution of the cylinder. In the invention, the single elongated element 200 in the hollow cylinder 210 has a twist in a second direction opposite to the first direction such that when the single elongated element is unwound it has essentially no twist. "Essentially no twist" in this application is defined to mean less than 3 twists per linear foot. In a more preferred embodiment, the unwound elongated element 200 has less than 2 twists per linear foot, more preferably less than 1 twist per linear foot. Preferably, the single elongated element 200 contains approximately 1 twist per revolution of winding around the hollow cylinder 210.

Sometimes when referring to twist, the designation of an s direction and a z direction is used. Using these designations, the elongated element 200 is wound in a first direction, the "s" direction, to form the cylinder 210 and the elongated element has a twist in the second direction, the "z" direction, to counteract the "s" direction so that when the element 200 is unwound it has essentially no twist. The nomenclature may also be used in reverse with the elongated element being wound in the "z" direction and the element having twist in the "s" direction.

In one embodiment, the hollow cylinder 210 contains a spool. This spool may be used to wind the elongated element 200 into the hollow cylinder 210 and it may be removed after winding or left in place depending on the end use and container 100 configuration. The single elongated element 200 may be wound into the hollow cylinder in any suitable method. In one embodiment, the element 200 is stack wound to form the hollow cylinder 210. In another embodiment, the element 200 is cross wound to form the hollow cylinder 210.

Figure 3:
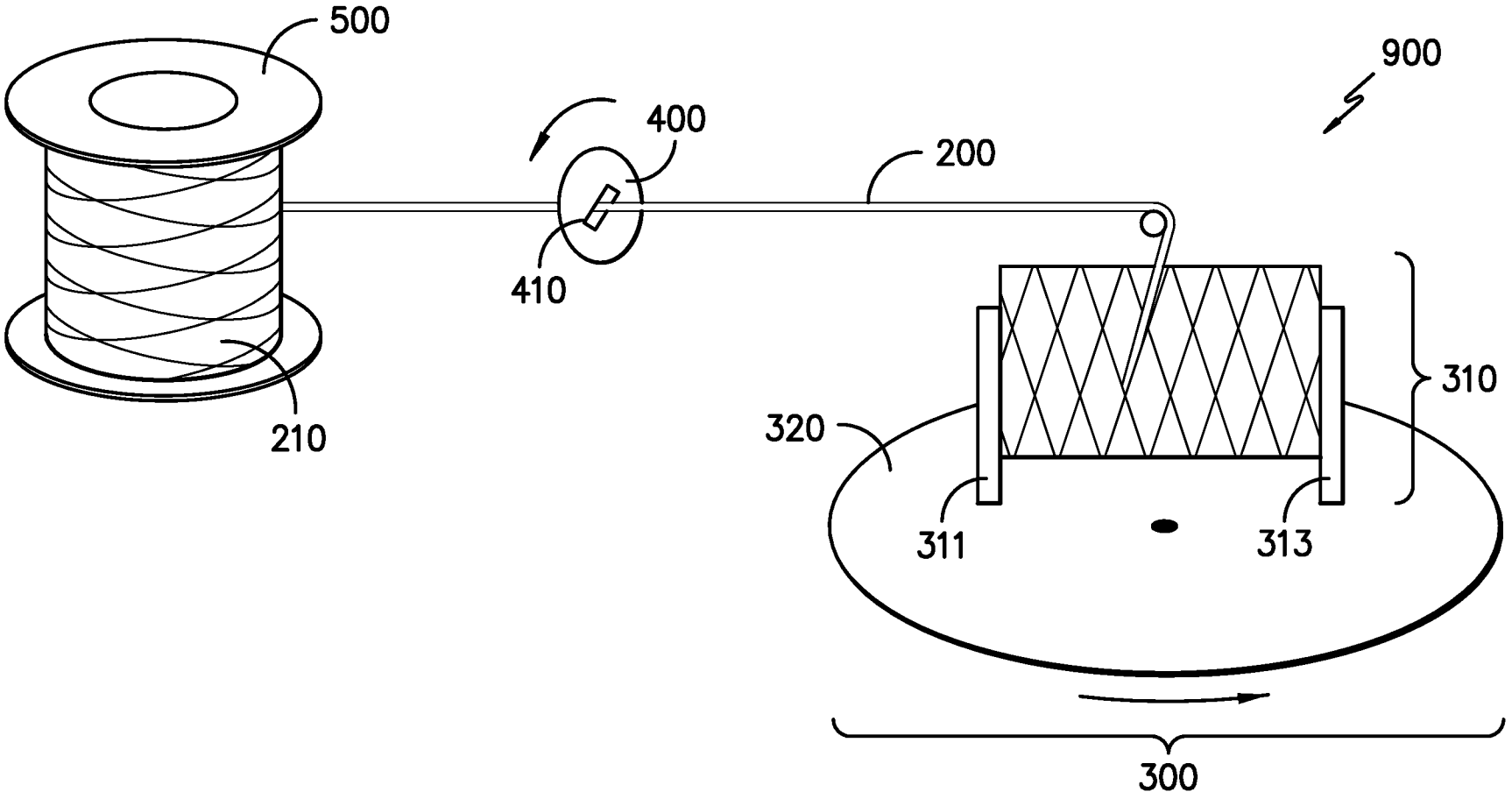
FIG. 3 is an illustration of one embodiment of the winding system.

FIG. 3 shows an illustration of the winding system machinery and process to create the wound element 200 used in the dispenser system 10 of FIGS. 1A and 1B. The winding system 900 begins with a left off stand 300. The left off stand 300 comprises a tape holder 310 and a generally planar base 320. The tape holder 310 is configured to hold a single elongated element and the base 320 rotates in a first direction within the plane of the base (shown by the arrow in the illustration, but the base may also rotate in the opposite direction).

The tape holder 310 is configured to hold the single elongated element and may have any suitable shape. In one embodiment, the tape holder 310 is a box which holds the element 200 in a loose or folded manner. In another embodiment (shown in FIG. 3), the tape holder 310 is configured to hold a let off roll (also called a master roll) of the elongated element 200 (the let off roll typically being larger and containing a longer length of the element 200 than the hollow cylinder 210 does. In one embodiment, the plane of the base of the left off stand is generally parallel to the floor. In another embodiment, the base of the left off stand is generally perpendicular to the floor.

In the embodiment where the left off stand 300 holds a master roll, the tape holder 310 is a roll holder to hold a let off roll. The let off roll has a generally cylindrical shape, a central axis, and a first and second parallel annular bases perpendicular to the central axis. The roll holder comprises a first leg 311 configured to engage the let off roll at the first annular base and a second leg 313 configured to engage the let off roll at the second annular base such that the let off roll is able to rotate circumferentially about the central axis of the roll. The base 320 is generally perpendicular to the first leg 311 and second leg 313 and is generally parallel to the central axis of the let off roll. Preferably, the element 200 is left off of the roll from the sides of the roll (preferably not from one of the annular bases).

After the single elongated element 200 is released from the let off stand 300, it passes through a winding coordinator 400. The winding coordinator 400 comprises a generally planar section having an opening 410 for the elongated element 200. The role of the winding coordinator is to twist the elongated element 200 the correct amount such that when it is wound up into the cylinder 210 it has an amount of twist in a first direction that when it is then unwound from one of the annular bases, the elongated element has essentially no twist. In the embodiment where the elongated element 200 is a pull tape or other flat tape like article, the opening 410 is preferably slit shaped.

The winding coordinator 400 rotates in a second direction opposite to the first direction (direction that the let off stand 300 is rotating). The let off stand 300 rotating is to counteract the rotation of the winding. In the winding system 900, the base of the left off stand 300 rotates in the first direction with a first frequency and the generally planar section of the winding coordinator 400 rotates in the second direction with a second frequency. Preferably, these first and second frequencies are approximately equal as to keep twists from building up in the element 200 between the let off stand 300 and the winding coordinator 400.

After the elongated element 200 has the proper amount of twist imparted by the winding coordinator 400, it is circumferentially wound onto a wind-up stand 500 which contains a spool core to create the hollow cylinder 210. The hollow cylinder 210 may be removed from the spool core or the spool core may be left in the hollow cylinder 210. The hollow cylinder being a three-dimensional region bounded by inner and outer concentric cylindrical sections and two parallel annular bases perpendicular to the central axis, wherein the single elongated element comprises a plurality of twists, approximately one twist for each full circumferential winding rotation of the single elongated element within the hollow cylinder.

After the hollow cylinder 210 is completely formed, it is packaged within the container 100 to form the dispenser system 10. The cylinder may be wrapped with plastic or other material before being loaded into the container. In addition, the container 100 may contain materials to hold the cylinder 210 in place within the container 100 such as foam, tabs, or rods between the inner surface of the container and the outside of the cylinder. The single elongated element 200 may be wound into the hollow cylinder 210 in any suitable method. In one embodiment, the element 200 is stack wound to form the hollow cylinder 210. In another embodiment, the element 200 is cross wound to form the hollow cylinder 210.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A method of winding comprising:

unwinding a single elongated element off a let off roll, wherein the let off roll is located in a let off stand comprising a roll holder and a generally planar base, wherein the roll holder is configured to hold a roll, wherein the let off roll has a generally cylindrical shape, a central axis, and a first and second parallel annular base perpendicular to the central axis, wherein the roll holder comprises a first leg configured to engage the let off roll at the first annular base and a second leg configured to engage the let off roll at the second annular base such that the let off roll is able to rotate circumferentially about the central axis of the let off roll, wherein the base is generally perpendicular to the first leg and second leg and is generally parallel to the central axis of the roll, wherein the base rotates in a first direction within the plane of the base with respect to the central axis of the let off roll:

passing the single elongated element through a winding coordinator comprising a generally planar section, wherein the generally planar section has an entrance side and an exit side, wherein the generally planar section comprises an opening which the single elongated element passes through, and wherein the generally planar section rotates in a second direction opposite to the first direction as viewed from the entrance side of the generally planar section, wherein the let off roll and the winding coordinator rotate at approximately the same frequency;

circumferentially winding the single elongated element on a wind-up stand comprising a spool core forming a hollow cylinder having a central axis, the hollow cylinder being a three-dimensional region bounded by inner and outer concentric cylindrical sections and two parallel annular bases perpendicular to the central axis, wherein the single elongated element comprises a plurality of twists, approximately one twist for each full circumferential winding rotation of the single elongated element within the hollow cylinder.

2. The winding system of claim 1, wherein the plane of the base of the left let off stand is generally parallel to the floor.

3. The winding system of claim 1, wherein the opening in the winding coordinator has a slit shape.

4. The winding system of claim 1, wherein the elongated element is a tape element.

5. A method of winding comprising:

unwinding a single elongated element from a tape holder stand, wherein the tape holder stand comprises a tape holder and a generally planar base, wherein the tape holder is configured to hold elongated elements, wherein the base rotates in a first direction within the plane of the base with respect to the central axis of the let off roll;

passing the single elongated element through a winding coordinator comprising a generally planar section, wherein the generally planar section has an entrance side and an exit side, wherein the generally planar section comprises an opening which the single elongated element passes through, and wherein the generally planar section rotates in a second direction opposite to the first direction as viewed from the entrance side of the generally planar section, wherein the let off roll and the winding coordinator rotate at approximately the same frequency;

circumferentially winding the single elongated element on a wind-up stand comprising a spool core forming a hollow cylinder having a central axis, the hollow cylinder being a three-dimensional region bounded by inner and outer concentric cylindrical sections and two parallel annular bases perpendicular to the central axis, wherein the single elongated element comprises a plurality of twists, approximately one twist for each full circumferential winding rotation of the single elongated element within the hollow cylinder.

6. The winding system of claim 5, wherein the opening in the winding coordinator has a slit shape.

7. The winding system of claim 5, wherein the elongated element is a tape element.

8. The winding system of claim 5, wherein the elongated element is a pull tape.

* * * * *